United States Patent [19]

Inoue et al.

[11] Patent Number: 4,540,323

[45] Date of Patent: Sep. 10, 1985

[54] METAL CONTAINERS AND THEIR MANUFACTURING METHOD AND APPARATUS

[75] Inventors: Makoto Inoue; Hirofumi Irie; Youichi Kobayashi; Tetuo Kubota, all of Tokyo, Japan

[73] Assignee: Nittetsu Steel Drum Co., Ltd., Tokyo, Japan

[21] Appl. No.: 591,527

[22] Filed: Mar. 20, 1984

Related U.S. Application Data

[60] Division of Ser. No. 344,076, Jan. 28, 1982, abandoned, which is a continuation-in-part of Ser. No. 264,768, May 18, 1981, abandoned.

[51] Int. Cl.[3] ..... B21D 39/00

[52] U.S. Cl. ..... 413/6; 413/36; 413/75

[58] Field of Search ..... 413/41, 74, 75, 62, 413/6, 36; 29/446, 509, 511, 512; 220/79, 67

[56] References Cited

U.S. PATENT DOCUMENTS 4,392,295 7/1983 Sasai ..... 413/36

*Primary Examiner*—Leon Gilden

*Attorney, Agent, or Firm*—Wenderoth, Lind & Ponack

[57] ABSTRACT

A cylindrical metal container with a relatively large holding capacity has triple seams having a vertically long, generally elongate rectangular cross section, the top and bottom parts of the seam having a convex substantially semi-elliptical or semi-circular profile. The outer face of the seam bulges outward adjacent its top, or its top and bottom, and the middle part between the top and bottom constitutes a pressed groove between the top and bottom and substantially parallel to the axis of the container. The body and end plate flanges are held in strong and direct contact with each other, overlapping each other in the center of the seam. A sealing compound is sealed in a void left between the edge of one flange and the curved portion of the other flange. The seam is formed by nip-bending the edge of the end plate flange with the first (entry-side) corner of a forming groove in a nip-bending and press-forming roll, seaming together the body and end plate flanges with the forming groove in a seaming roll, then, upon completion of seaming, press forming the seam thus formed into a desired shape with the forming groove in the afore-mentioned nip-bending and press-forming roll. A special nip-bending recess is provided at the first or entry side corner of the forming groove in the nip-bending and press-forming roll.

4 Claims, 18 Drawing Figures

METAL CONTAINERS AND THEIR MANUFACTURING METHOD AND APPARATUS

This application is a divisional application of application Ser. No. 344,076 now abandoned, filed Jan. 28, 1982, which is a continuation-in-part application of application Ser. No. 264,768, filed May 18, 1981 abandoned.

BACKGROUND OF THE INVENTION

This invention relates to metal containers, particularly cylindrical metal containers with relatively large holding capacities, such as steel drums, made by fastening end plates to both ends of a cylindrical body by seaming, and the method of manufacturing and the apparatus therefor.

The description in this specification will refer to steel drums as a typical example of such metal containers.

A steel drum is made by fastening a round end plate to each end of a cylindrical body. The fastening is generally accomplished by laying together the flanges at each end of the body and around the circumference of the end plate and then bending them over in folds. During the forming process, a sealing compound is applied between the folds or in the seam to prevent the leakage of drum contents therethrough.

In forming the seam, a tray-like end plate is first fitted in both ends of a cylindrical can body, each end having a flange extending perpendicular to the longitudinal axis of the body. A seaming chuck having a cylindrical forming face is fitted in the end plates, which are then held, and turned around the can body axis along the can body. A seaming roll having a forming groove is pressed against the forming face of the seaming chuck, with the edges of the flanges on the body and end plates held in the forming groove. Consequently, the flange edges are guided along the side and bottom of the forming groove and thereby become folded and seamed together. Then, the seam is pressed and the shape corrected between the seaming roll and the forming face of the seaming chuck, thereby attaining a closer contact between the flanges.

The drum seam thus formed has an important bearing on the quality of the drum, including its strength and leakage proofness. Formed along the outer edges of the drum, the seam is likely to strike against other objects when the drum is raised or lowered or during transportation, which will probably cause the deformation, loosening and cracking of the seam. This leads to leakage. To avoid such deformation, loosening and cracking of the seam, many proposals have been put forward and implemented with respect to the structure of the seam and the method and apparatus for making the seam.

For example, structures of the seam are disclosed in U.S. Pat. Nos. 3,736,893 and 3,987,927.

The seam according to U.S. Pat. No. 3,763,893 is formed by helically wrapping the flanges of the body and end plate which have been laid one over the other. Having a round cross-section, this seam, it is claimed, develops a large moment of inertia and, therefore, a great strength in the direction of its radius. In this seam, however, the flanges of the body and end plate are held in contact with each other simply as a result of enfolding. In addition, this seam has a relatively large void in the center, so that a filler must be put in the void to insure adequate leakage-proofness. This use of the sealing compound not only entails an increase in production cost, but also involves a risk of degenerating the contents of the drum that may possibly come in contact therewith.

The seam according to U.S. Pat. No. 3,987,927 has an egg-like or elliptical cross section, with a relatively small radius of curvature at the top of the seam (where the first fold is made). The strength at the seam top is increased because of the work hardening resulting from the reduced radius of curvature. This, however, is likely to cause excess deformation of the seam, which, in turn, may lead to cracking. If no great pressure is applied to the seam in the final stage of the seaming process, the contact between the hooked edges in the center of the seam is less close than when great pressure is applied. If sufficient force is supplied to sufficiently tighten the seam, the pressed part may develop cracks because of work hardening.

A method and apparatus for making drums, particularly those for forming drum seams, are required to provide seams with high leakage-proofness and strength in an easy and sure manner. Recently, furthermore, the demand for drums make of lighter-guage steel sheets has increased. To provide greater strength, the use of a triple seam is popular in this type of drums.

SUMMARY OF THE INVENTION

This invention has been made with a view to solving the afore-mentioned problems relating to the metal containers.

An object of this invention is to provide a metal container having high leakage-proofness and strength.

Another object of this invention is to provide a method and apparatus for readily manufacturing metal containers with a seven-fold seam, i.e. a seam with seven layers, and which can be achieved by modifying existing equipment at a small cost.

In the metal container according to this invention, the top of the seam has a substantially semi-elliptical or semi-circular cross section, with the external sides thereof arched out to provide a large radius of curvature. Accordingly, even if the seam is subjected to a shock, the top of the seam undergoes less stress concentration.

The overall seam has a substantially rectangular cross section with rounded corners, the long sides of which extend vertically. Therefore, the body flange and end plate flange held in contact with each other are parallel to the axis of the body. By strongly pressing the middle part thereof in the direction of the radius of the body, using a nip-bending and press-forming roll, the space left between the two flanges is eliminated, thereby bringing the two flanges into metallic contact, and increasing the strength and tightness of the seam. Because such pressing leaves only a very small space, the seamed part will provide adequate leakage-proofness, and only a small quantity of sealing compound need be used. Filling the very limited space which is left, the sealing compound adds to the tightness of the seam. Furthermore, since the two pressed flanges are kept in metallic contact, the sealing compound hardly ever comes in contact with the contents of the container. Consequently, contamination of the contents of the container by the sealing compount and deterioration of the sealing compound by the container contents can be avoided. Thus, this pressing is an essential step in the manufacturing method of the present invention.

In the metal container according to this invention, the radially outer layer of the seam is wave-shaped in cross-section, arching outwardly at the top and bottom. This cross-sectional shape permits concentrating the pressing force in the recessed part, i.e. in a pressed groove, between the outwardly arched parts at the top and bottom, which eliminates the space left between the body flange and end plate flanges and thereby brings them closer contact. Further, this pressing force applied to the middle part of the seam causes the top and bottom of the seam to arch outwardly. The types of damage to the seam an be classified into tearing off and cracking of the seam element. A leak in the seam develops when the seam becomes loose or is torn off and some parts of the seam crack. Therefore, the strength of the seam may be defined as the resistivity to such tearing off or loosening and cracking.

The pressing applied to the middle part of the seam reduces the space left therein to a minimum and thereby produces a tightly interengaged seam having good strength with respect to loosening.

A seam which is pressed with a large force around the entire periphery of the cross-section for the prevention of loosening sometimes develops cracks, mostly in parts which have been subjected to an external force in addition to the excess work hardening. This type of cracks develop mostly on the seam top and bottom. It is therefore desirable to confine the pressing to the middle part of the seam that receives hardly any external force. The development of the cracks can be prevented by selecting the proper quality of steel. In addition, the bottom part of the seam is subjected to a relatively smaller force than the top, since it is mostly the top part that strikes against other objects. Therefore, the bottom part can be pressed simultaneously with the middle part, provided the quality of the metal is properly selected.

In the metal container manufacturing method according to this invention, the edge of the end plate flange is first laterally bent over into a V-shape, prior to seaming, by a nip-bending groove (hereinafter called recess), the cross-section of which is comprised of two different circular arcs, one being a circular arc having a radius of curvature less than the thickness of the end plate flange, specially provided at the first corner in the nip-bending groove of the nip-bending and press-forming roll. This edge bending permits readily enfolding the body and end plate flanges into a seven-fold seam. Using the nip-bending and press-forming roll for this edge bending and also for finishing the shape of the seam, the method and apparatus according to this invention can dispense with the need to prepare separate rolls for nip-bending and pressing. This permits using one and the same roll effectively for two different operations, thereby simplifying the manufacturing apparatus and increasing the operating efficiency.

In the metal container manufacturing apparatus according to this invention, furthermore, there is provided a recess, having an arched cross section, comprising two curves in the first corner of the forming groove in the nip-bending and press-forming roll. The edge of the end plate flange is bent in along the first curve of the two curves of this recess, with a relatively small radius of curvature (approximately 2.0 to 2.5 times greater than the thickness of the sheet material), and nip-bent or laterally-bent to an angle of not smaller than 90 degrees and not larger than 150 degrees, preferably 120 to 140 degress, by the second curve of the two curves of this recess, with a relatively very small radius of curvature (approximately 0.1 to 1.0 times the thickness of the sheet material). Then the nip-bending and press-forming roll comes to a halt and waits, and simultaneously the seaming roll starts to roll the flanges. The seaming roll further rolls the flange of the end plate, thus nip-bent at its edge, together with the flange of the body plate into the seven-fold seam. Since the forming groove in the seaming roll is shaped to form a seam substantially like a portion of spiral in cross section, the flange of the end plate becomes smoothly spirally curved, without being subjected to any localized excess working, and, after making one turn, comes in contact with the body plate flange. At this time, the end plate flange edge is curved through an angle of more than 280 degrees. After the first spiral has been formed, the seaming roll completes the rolling of the seven-fold seam (comprising seven layers) while not yet interengaging the edges of the flanges in the center of the seam. Then the seaming roll comes to a halt and is retracted. Simultaneously the nip-bending and press-forming roll starts to press-form the seam. The recess of the forming groove in the nip-bending and press forming roll finishes the shape of the arched parts mentioned previously. The convex or flat middle part of the forming groove in the nip-bending and press-forming roll press forms the press groove on the middle part of the seam. Thus, the recess in the forming groove has a double function; (1) to nip-bend the flange edge, and (2) to press-form a press groove on the middle part of the seam and to finish the shape of the arched parts of the seam.

DETAILED DESCRIPTION OF THE PREFERRED EMBODIMENTS

Now preferred embodiments of this invention will be described with reference to the accompanying drawings.

Figure 1:
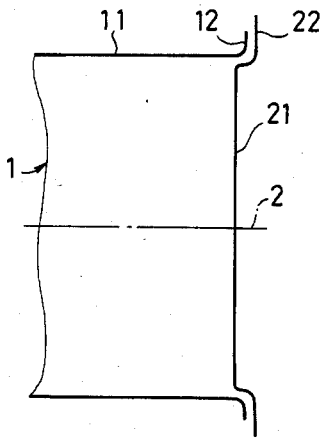
FIG. 1 is a schematic partial cross-sectional view showing end plates fitted in a body.

FIG. 1 shows a stage just prior to the seaming operation, in which a tray-like end plate 21 is simply fitted in the cylindrical body 11 of a drum 1. As shown, each end of the body 11 is bent outwardly, perpendicular to the axis 2 of the body, to form a flange 12. Likewise, the edge of the cylindrical portion of end plate 21 is also bent so as to extend along the flange 12 of the body, forming a flange 22.

Figure 2:
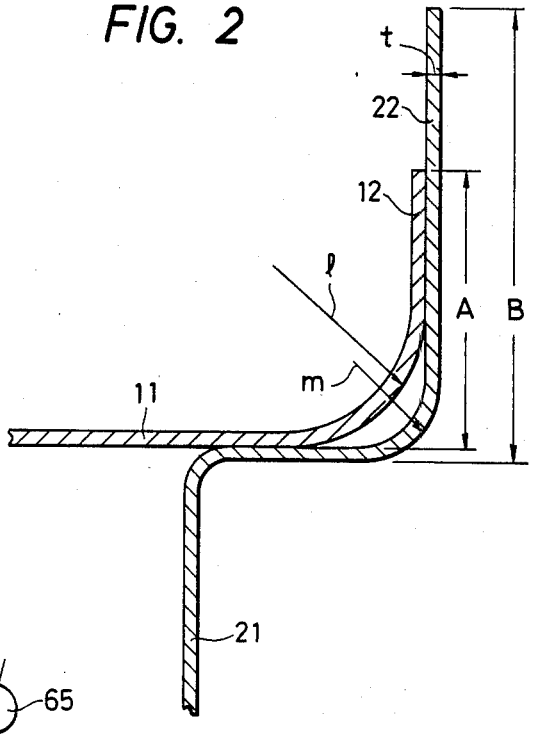
FIG. 2 is an enlarged cross section showing the flange portions of the body and the end plate.

FIG. 2 is a detailed cross section showing the flanges 12 and 22. As shown, the base portions of the flanges 12 and 22 are bent with radii of curvature l and m respectively, the flange 22 of the end plate 21 being longer than the flange 12 of the body 11. The flange lengths A and B must be great enough to form a seven-fold seam. The radii of curvature l and m at the flange base are such that the flanges 12 and 22 smoothly enter the forming groove in a seaming roll for bending. According to the experience of the inventors, the preferable radii of curvature are as follows:

$$l=(10\sim16)\times t$$

$$m=(5\sim10)\times t$$

wherein t=thickness of sheet metal

The pre-assembled body and end plate are then held by a seaming chuck and seamed together by a seaming roll.

Figure 3:
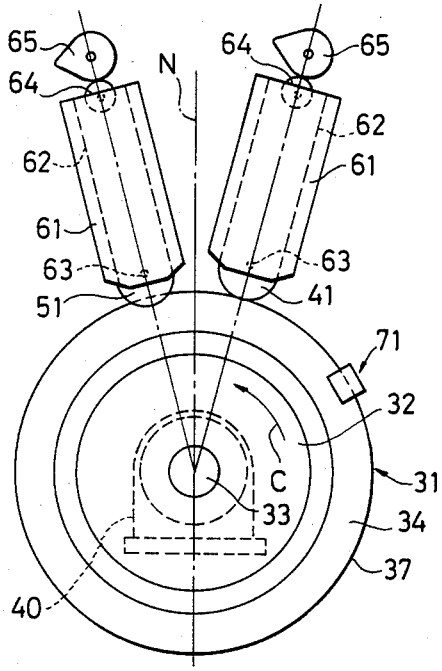
FIG. 3 is a schematic front view of a seaming apparatus according to the invention.

FIG. 3 is a schematic front view of a seaming apparatus. A seaming chuck 31 is attached to a base plate 32. The seaming chuck 31 and base plate 32 are rotated together in the direction of arrow C by a drive shaft 33. The seaming chuck 31 is fitted in the cylindrical portion of the end plate 21, whereby the body 11 and end plate 21 are supported by the seaming chuck 31 against radially inwardly directed forces.

A seaming roll 41 and a nip-bending and press-forming roll 51 are provided at fixed points spaced radially outwardly of the seaming chuck 31. The two rolls 41 and 51 are circumferentially inclined at a suitable angle (for example, 15 degrees) with respect to a vertical center line N. The rolls 41 and 51 are each rotatably supported, on a shaft 63, by the lower end of a press-down member 62 that moves up and down, guided by a casing 61. The rolls 41 and 51 rotate, following the rotation of the seaming chuck 31 through the seamed part of the body and end plate. A contact roller 64 is rotatably attached to the top of each press-down member 62, and a cam 65 is held in contact with each contact roller 64. As a cam 65 rotates, the corresponding press-down member 72 moves up and down to move the seaming roll 41 and nip-bending and press-forming roll 51 in the direction of the radius of the seaming chuck 31.

A guide 71 is provided adjacent to the seaming chuck 31. The guide is spaced clockwise from the seaming roll 41 at a suitable angle (for example, 45 degrees). The guide 71, with a guide roll (now shown) provided thereon, correctly leads the flanges of the body and end plate into the forming groove of the nip-bending and press-forming roll 51 and the seaming roll 41.

Figure 4A:
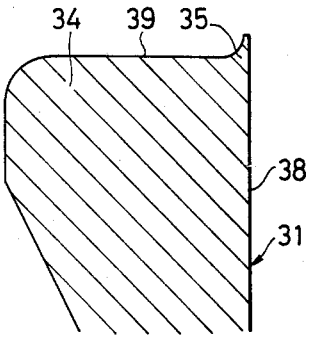
FIG. 4(*a*) is a cross section of the forming section of a seaming chuck according to this invention, and FIG. 4(*b*) is a cross section on an enlarged scale showing a fillet provided on said forming section.
Figure 4B:
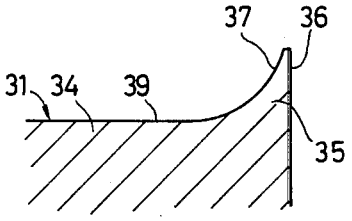

FIGS. 4*a* and 4*b* show a preferred shape of the forming section of the seaming chuck.

Figure 5:
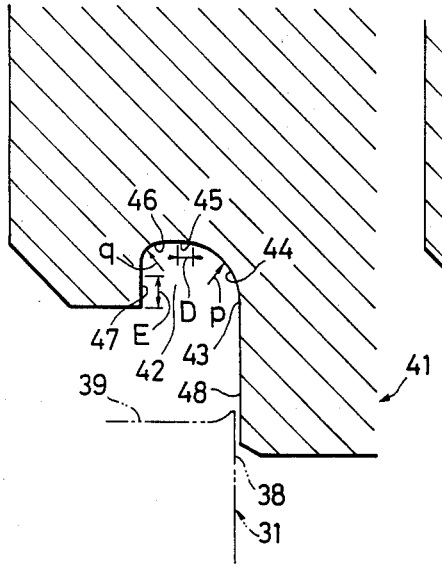
FIG. 5 is an enlarged partial cross section of the forming groove cut in a seaming roll according to this invention.

As shown, the seaming chuck 31 has a fillet 35, which is substantially triangular in cross section, on the cylindrical forming section 34 thereof. One surface 36 of the fillet 35 extends along a datum plane 38 that lies close and opposite to the entry-side guide plane 48 of the seaming roller 41. The other surface of the fillet 35 is an inclined surface (hereinafter called the inclined fillet surface 37). When the seaming roll 41 approaches the seaming chuck 31, the inclined fillet surface 37 faces the exit-side corner 46 of the forming groove 42 of the seaming roll as shown in FIG. 5.

With a seaming chuck having such a forming face, the corner of the inner edge of a seam is smoothly bent to make the seam angle-free, solid and tightly packed. Yet, the seaming chuck need not always have said fillet.

The seaming roll 41 bends, rolls in, and seams the flanges 12 and 22 of the body 11 and end plate 21 respectively, for holding the two together. FIG. 5 is a cross section of the seaming roll 41, which has a circumferential forming groove 42. The forming groove 42 is substantially D-shaped, opening toward the forming face 39 of the seaming chuck 31. In the forming groove 42, the portion between the entry-side surface (from which the flanges enter; on the right side in the figure) and a first corner 44 has a cross-sectional shape which is substantially the quadrant of a circle. The groove bottom 45 following the first corner 44 is flat. The flat part makes the seaming smooth and harmonious. A second corner 56 following the groove bottom 45 has a cross-sectional shape is defined by a quadrant the radius of curvature of which is smaller than that of the first corner 44. The exit-side surface 47 following the second corner 46 extends straight. A guide plane 48 extends downward below the entry-side surface 43 so that the flanges 12 and 22 coming into the forming groove 42 are guided therealong.

To form a good-shaped, tight seam, the cross-sectional dimensions of the forming groove 42 should fall within the following ranges:

Radius of curvature of the first corner:

$$P=(3.0\sim6.0)\times t$$

Radius of curvature of the second corner:

$$q=(1.5\sim3.0)\times t$$

Length of the straight groove bottom:

$$D=(0\sim3.0)\times t$$

Length of the exit-side surface:

$$E=(1.5\sim4.0)\times t.$$

Since there are substantial spaces left after the seaming, the seam is not yet complete.

Figure 6:
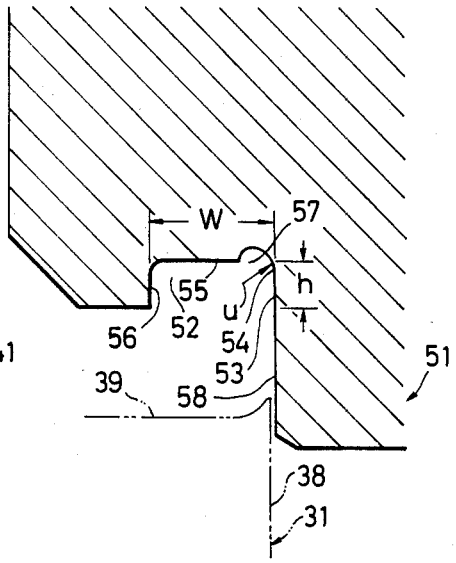
FIG. 6 is an enlarged partial cross section of the forming groove cut in a nip-bending and press-forming roll according to this invention.
Figure 7:
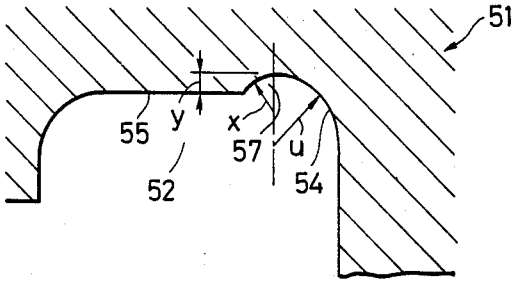
FIG. 7 is an enlarged cross section of the forming groove shown in FIG. 6.

The nip-bending and press-forming roll 51 corrects the shape of the seam formed by the seaming roll 41 and accomplishes tight interlocking of the seam by pressing. FIG. 6 is a cross section of a nip-bending and press-forming roll that press-forms the seam shaped by the seaming roll into a substantially rectangular cross-sectional shape. The nip-bending and press-forming roll 51 has a circumferential forming groove 52. The forming groove 52 is substantially rectangular in cross section, opening toward the forming face 39 of the seaming chuck 31. A first corner 54 and a second corner 56 of the forming groove 52 are substantially in the shape of quadrants of circles. The depth h and width w of the forming groove 52 are equal to $\frac{1}{2}$ of the thickness and to the height of the seam, respectively. At the first corner 54 of the forming groove 52, there is provided a recess 57 that is arched in cross section. As shown in FIG. 7, the bottom of the recess 57 is substantially defined by a sextant of a circle, having a radius x, which follows the quadrant of a circle (radius=u) that substantially defines the first corner 54. Preferable dimensions of the individual corners are as follows:

Radius of curvature u=(2 to 2.5)t mm,

Radius of curvature x=(0.1 to 1.0)t mm,

Depth y=0.5t mm {(0.3 to 0.8)t mm is allowable}.

A guide plane 58 extends downward from the entry-side surface 53 of the forming groove 52 so that the seamed flanges coming into the forming groove 52 are guided therealong.

The following describes the method of seaming the flanges of the body and end plate using the apparatus described above.

Figure 8:
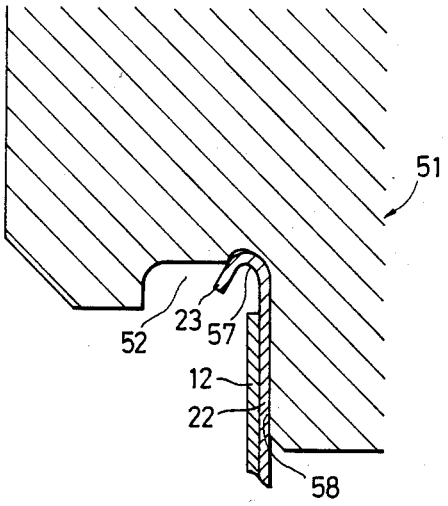
FIG. 8 illustrates the nip-bending process according to this invention.

To begin with, the edge 23 of the end plate flange 21 is nip-bent by means of the nip-bending and press-forming roll 51. When the nip-bending and press-forming roll 51 is moved toward the seaming chuck 31, the cylindrical part 39 thereof supports the cylindrical portions of the end plate and the body, whereupon the flange edge 23 of the end plate 2, supported by the seaming chuck 31, enters the forming groove 52, being guided along the guide plane 58. (Actually the forming groove 52 moves down over the flange, but relative to the nip-bending and press-forming roll the flange moves into the groove.) While traveling along the bottom of the recess 57 in the forming groove 52, the flange edge 23 becomes bent as shown in FIG. 8. The flange edge 23 thus bent is sharply bent or nip-bent to an angle of over 90 degrees by the circular arc 57 having a radius of curvature less than the thickness of the end plate flange. The extreme end of the flange 23 is not bent but the part following the end of the flange 23 is sharply bent, since bending by the small radius of curvature less than the thickness of the flange is very difficult.

Before or after this nip-bending process, a sealing compound is supplied to a point near the edge 13 of the flange 12 on the body 11.

Figure 9A:
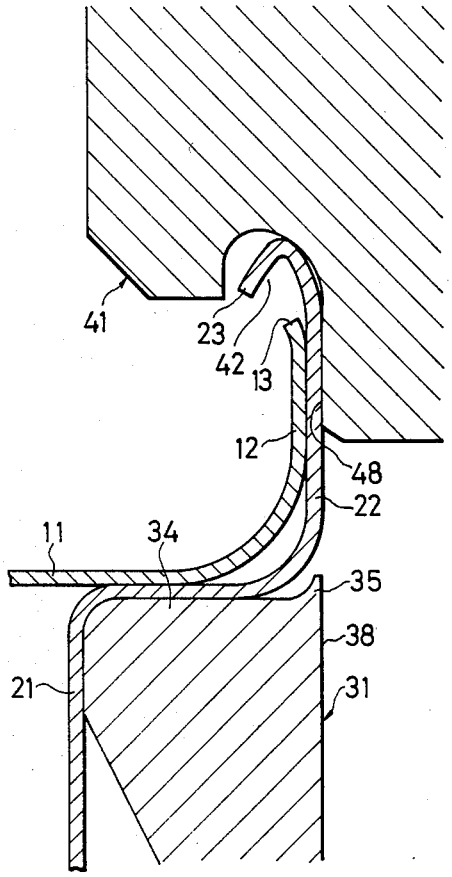
FIGS. 9(*a*), (*b*), and (*c*) illustrate the progressive bending of the seam in seaming process according to the invention.
Figure 9B:
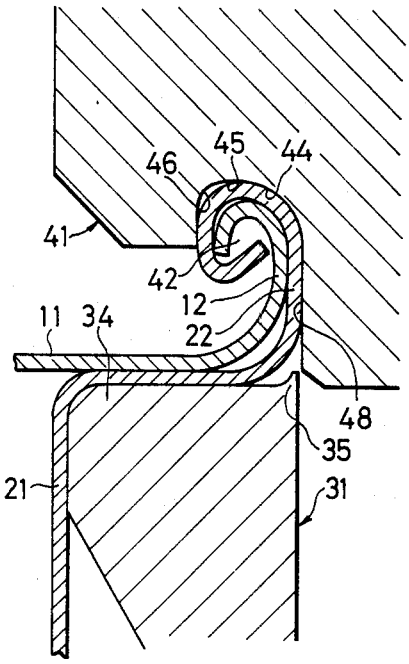
Figure 9C:
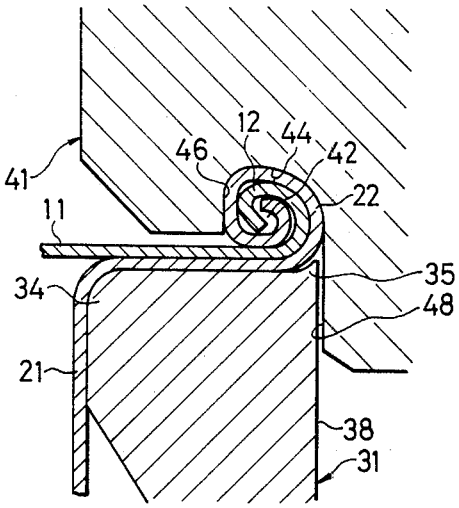

Upon completion of nip-bending, the seaming roll 41 is moved toward the seaming chuck, with the nip-bending finishing roll 41 remaining on standby where it is, i.e. without moving either toward or away from the seaming chuck 31, and the seaming roll 41 rolls in the body flange 12 and end plate flange 22. FIG. 9(*a*) shows an initial stage, FIG. 9(*b*) an intermediate stage, and FIG. 9(*c*) a later stage of the seaming process.

On further pushing the seaming roll 41 toward the seaming chuck 31, the flanges 12 and 22, when considered as moving relative to the seaming roll, pass through the guide plane 38 into the forming groove 42. After being curved along the first corner 44, the flanges 12 and 22 pass along the flat groove bottom 45 into the second corner 46. The flanges 12 and 22, pre-curved at the first corner 44, are further curved at the second corner 46 to a greater curvature. Thus, the forming groove 42 curves the flanges 12 and 22 in two steps, with different radii of curvature. This enables smooth fabrication, applying great seaming action on the flanges 12 and 22 and without causing excess deforming stress.

Figure 10:
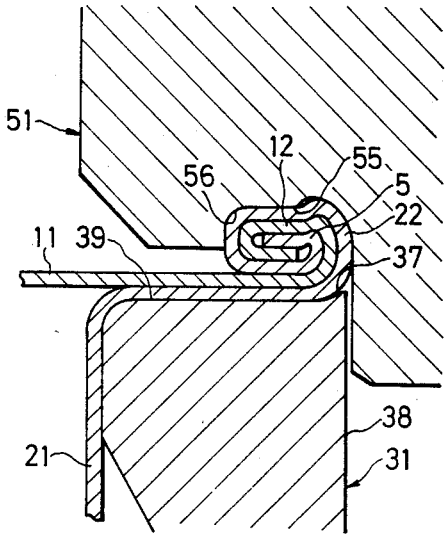
FIG. 10 illustrates the seam finishing process according to the invention.

By the further movement of the seaming roll 41 toward the seaming chuck 31, the seam thus formed is corrected to a desired shape and further pressed for strengthening. FIG. 10 is a cross section of the seam thus corrected and strengthened. When the seam 5, shown in FIG. 9(*c*), has been formed, the seaming roll 41 is withdrawn (upward in FIG. 2) and the nip-bending and press-forming roll is moved down. Then, the external half (or the upper half in FIG. 10) of the seam 5 enters the rectangular forming groove 52, where the seam is pressed and formed between the forming plate 39 of the seaming chuck 31 and the bottom 55 of the forming groove 52 by pressure in the direction of the thickness thereof and pressure diagonally by the inclined fillet surface 37 and the exit-side corner 56 of the forming groove 52. Consequently, the seam is exactly and tightly formed into the desired shape and any small space left between the two flanges is eliminated and the two flanges are brought into metallic contact.

Figure 11:
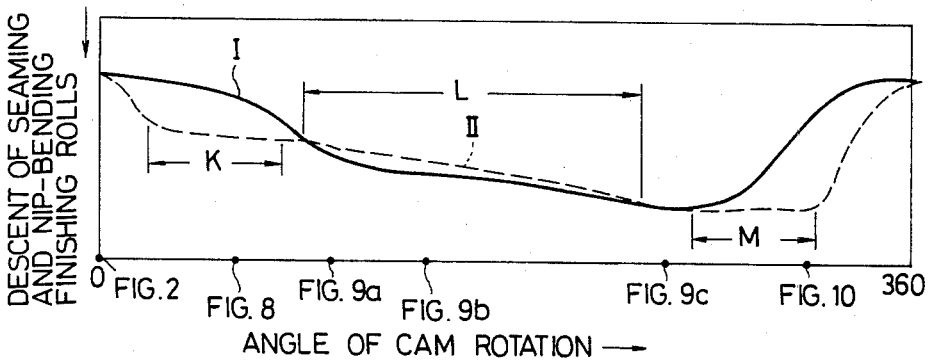
FIG. 11 is a diagram showing the relationship between the rotating angle of a cam that raises and lowers the seaming and nip-bending and press-forming rolls and the descent and rise of the rolls.

FIG. 11 graphically shows the relationship between the rotating angle of the cams that raise and lower the seaming and nip-bending and press-forming rolls and the amount of radial movement of the two rolls relative to the seaming chuck 31.

In FIG. 11, curves I and II show the movement of the seaming and nip-bending and press-forming rolls, respectively. Intervals K, L and M, respectively, show the nip-bending, seaming and press-forming processes. First, as shown in this figure, the flange edge 23 of the end plate 21 is nip-bent by moving the nip-bending and press-forming roll 51 toward the forming face of the seaming chuck 31 and past the withdrawn position of the seaming roll 41, by turning the cam 65 therefor. Then, the flanges 12 and 22 of the body 11 and end plate 21 are seamed together by moving the seaming roll radially toward the seaming chuck 31 past the nip-bending and press-forming roll 51. Finally, the seamed joint is finished by moving the nip-bending and press-forming roll radially toward the seaming chuck while withdrawing the seaming roll to its original position. This figure also shows the relationship of the forming processes shown in FIGS. 2, 8, 9(*a*), (*b*) and (*c*), and 10 with the rotating angle of the cam by indicating those figure Nos. on the abscissa.

Figure 12:
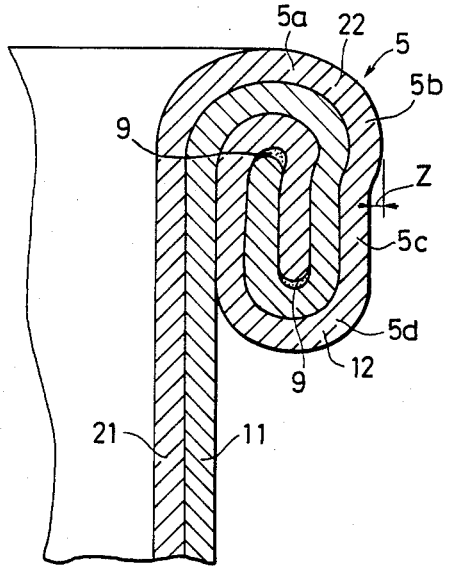
FIG. 12 is an enlarged cross section of a seam finished by the nip-bending and press-forming roll in FIG. 6.

FIG. 12 is an enlarged cross section of the seam 5 that has been formed as described above. The top 5*a*, being substantially semi-elliptical in cross section, was formed by the entry-side of the forming groove 52 of the nip-bending and press-forming roll 51 shown in FIGS. 6 and 10. The outwardly arched part 5*b* is a part that has projected, upon application of finishing pressure, into the recess 57 in the forming groove 52 of the nip-bending and press-forming roll 51. Preferably, the amount z by which the arched part 5*b* projects from the middle part 5*c* is substantially $\frac{1}{2}$ of the thickness of the metal sheet. Pressed by the flat bottom of the forming groove 52 in the nip-bending and press-forming roll 51, all layers of the body flange 12 and end plate flange 22 constituting the middle part 5*c* are parallel to the axis of the body. Strongly pressed in the direction of the radius of the body, the flanges 12 and 22 in the middle part 5*c* are held in direct contact with each other. The sealing compound 9 is held in separate voids left between the edges and curved portions of the body flange 12 and end plate flange 22. The bottom 5*d* of the seam 5 is similar in shape to the top 5*a*, though smaller in cross section.

Figure 13:
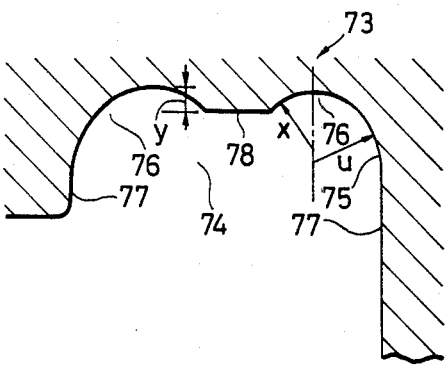
FIG. 13 is an enlarged cross section of the forming groove of another nip-bending and press-forming roll of this invention.
Figure 14:
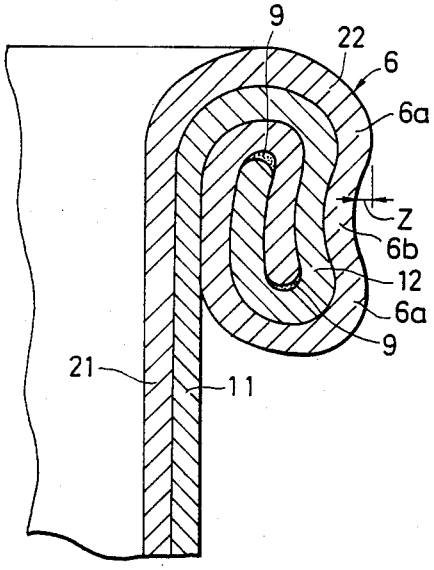
FIG. 14 is an enlarged cross section of a seam finished by the nip-bending finishing roll in FIG. 13.

FIG. 13 shows another embodiment of the forming groove cut in the nip-bending and press-forming roll. FIG. 14 is a cross section of the seam finished by this forming groove.

This forming groove 74 in the nip-bending and press-forming roll 73 has an arched recess 76 of the same size and shape at both the entry and exit side. The radius u of the corner 75 and the depth y of the recess 76 are substantially the same as those shown in FIG. 7. But the arc following the flat part 77, with the radius u, is substantially trisected. The bottom 78 lying between the two recesses 76 is in the shape of a convex curve or a straight line parallel with the axis of the body.

The seam 6 finished by the nip-bending finishing roll 73 has an arched part 6*a* at the top and bottom thereof. The amount of projection z is substantially the same as that shown in FIG. 12. Great pressure is applied on the middle part 6*b* between the two arched parts 6*a*. Since the finishing force applied by the nip-bending and press-forming roll 73 concentrates on the middle part 6*b*, the top and bottom of the seam 6 are not subjected to excess working. Accordingly, this seam 6 undergoes less work hardening at the bottom than the seam 5 in FIG. 12. Therefore, even if the seam 6 is excessively deformed while the container is being handled, the probability of developing cracks is very low.

Figure 15:
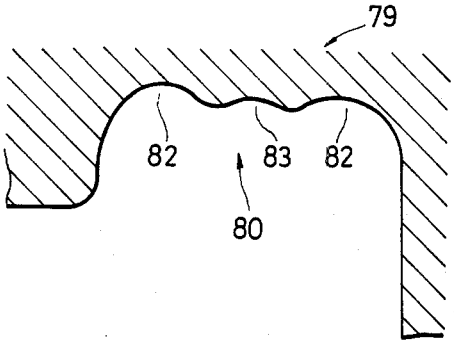
FIG. 15 is an enlarged cross section of the forming groove in still another nip-bending and press-forming roll according to this invention.

FIG. 15 shows still another embodiment of the forming groove in the nip-bending finishing roll. This forming groove 80 in the nip-bending finishing roll 79 has a recess 82 of the same size and shape at each of the entry and exit sides. There is an arched recess 83 between the two recesses 82. The seam finished by this nip-bending finishing roll 79 has a ripple in the middle part 6*b*.

The present invention is not limited to the specific disclosed shapes of the depression at the middle part 6*b* of the seam.

What is claimed is:

1. In a method of manufacturing a metal container which includes the steps of fitting a tray-like end plate into an end of a cylindrical body so that a body flange formed by bending the edge of the body outwardly perpendicular to the body axis overlaps an end plate flange formed by bending the edge of the end plate outwardly so as to extend along and beyond the body flange, fitting a seaming chuck having a cylindrical forming face into the indented part of the end plate and abutting the cylindrical portions of the end plate and body from which said flanges extend against said seaming chuck, and pressing a seaming roll and a nip bending and press forming roll radially inwardly against said flanges, each roll having a circumferential forming groove opening toward the forming face of the seaming chuck, while rotating the forming face of the seaming chuck so that the forming grooves seam the body and end plate flange into a seven-fold seam, the improvement comprising the steps of:

providing a nip bending recess in the corner of the cross-sectional profile of the forming groove in the nip bending and press forming roll which is toward the end of the container with said flanges thereon at the start of the action of said nip bending and press forming roll;

pressing said nip bending and press forming roll radially inwardly as a first seam forming step and bringing said nip bending recess into contact with said end plate flange for nip-bending the radially outer edge of said end plate flange;

then pressing said seaming roll inwardly for seaming the body and end plate flanges together with the forming groove of the seaming roll to form a rolled seam; and then, after completion of the pressing of said seaming roll, finishing press forming the seam into a desired shape by further pressing said nip bending and press forming roll inwardly for forcing the forming groove of said nip bending and press forming roll against the thus rolled seam for forcing the top radially outer portion of the seam into said recess and pressing the remainder of the seam into a flattened shape and pressing the parts of the flanges tightly together for forming a seam having, as a whole, a generally elongated rectangular shape when viewed in cross-section with at least the top portion of the radially outermost surface arching convexly outwardly and a middle portion thereof extending generally parallel to the axis of the container.

2. A method as claimed in claim 1 further comprising providing the other corner of the cross-sectional profile of said forming groove in said nip bending and press forming roll with a further recess, and, by further pressing said nip bending and press forming roll inwardly, forming the bottom portion of the radially outermost surface of said seam in an arch extending convexly outwardly.

3. In a method of manufacturing a metal container which includes the steps of fitting a tray-like end plate into an end of a cylindrical body so that a body flange formed by bending the edge of the body outwardly perpendicular to the body axis overlaps an end plate flange formed by bending the edge of the end plate outwardly so as to extend along and beyond the body flange, fitting a seaming chuck having a cylindrical forming face into the indented part of the end plate and abutting the cylindrical portions of the end plate and body from which said flanges extend against said seaming chuck, and sequentially pressing a seaming roll and a nip bending and press forming roll radially inwardly against said flanges, each roll having a circumferential forming groove opening toward the forming face of the seaming chuck, while rotating the forming face of the seaming chuck so that the forming grooves seam the body and end plate flanges into a triple seam, the improvement comprising the steps of:

providing a nip bending recess in the corner of the cross-sectional profile of the forming groove in the nip bending and press forming roll which is toward the end of the container with said flanges therein at the start of the action of said nip bending and press forming roll; with a nip-bending recess, moving the nip bending and press forming roll radially inwardly in a first seam forming step and bringing said nip-bending recess toward the edge of the plate flange for contacting the bottom of the recess and the edge of the plate flange for nip-bending the radially outer edge of the end plate flange;

stopping movement of the nip bending and press forming roll at a position where the nip-bent edge has a constant angle of from 90° to 150° and a predetermined length, and holding the nip bending and press forming roll at said position;

then moving the seaming roll toward the nip-bent edge for seaming the body and end plate flanges together with the forming groove in the seaming roll to form a rolled seam; and then, after completion of the movement of said seaming roll;

moving the seaming roll away from the thus rolled seam and simultaneously moving the nip bending and press forming roll further toward the seam for forcing the forming groove of said nip bending and press forming roll against the thus rolled seam for press forming the middle portion of the radially outer surface of the seam for forcing the top radially outer portion of the seam into said recess and pressing the parts of the flanges together and thereby simultaneously finishing the seam into a desired shape having, as a whole, a generally elongated rectangular shape when viewed in cross-section with at least the top portion of the radially outermost surface arching convexly outwardly and a middle portion thereof extending generally parallel to the axis of the container.

4. A method as claimed in claim 3 further comprising providing the other corner of the cross-sectional profile of said forming groove in said nip bending and press forming roll with a further recess, and, by further pressing said nip bending and press forming roll inwardly, forming the bottom portion of the radially outermost surface of said seam in an arch extending convexly outwardly.

* * * * *